United States Patent [19]

Witting

[11] Patent Number: 4,894,591

[45] Date of Patent: Jan. 16, 1990

[54] INVERTED EXCITATION COIL FOR HID LAMPS

[75] Inventor: Harald L. Witting, Burnt Hills, N.Y.

[73] Assignee: General Electric Company, Schenectady, N.Y.

[21] Appl. No.: 240,331

[22] Filed: Sep. 6, 1988

[51] Int. Cl.[4] ..... H05B 41/24

[52] U.S. Cl. ..... 315/248; 313/153

[58] Field of Search ..... 315/39, 111.51, 236, 315/248, 267, 344, 357; 313/146, 151, 152, 153, 234, 574, 607

[56] References Cited

U.S. PATENT DOCUMENTS 4,812,702 3/1989 Anderson ..... 315/344 X

*Primary Examiner*—David Mis

*Attorney, Agent, or Firm*—Geoffrey H. Krauss; James C. Davis, Jr.; Marvin Snyder

[57] ABSTRACT

A novel excitation coil for both starting and maintaining a plasma arc discharge within the envelope of an arc tube in an electrodeless HID lamp, has first and second solenoidally - wound coil portions, each having an axis substantially in alignment with the axis of the other portion. The coil conductor of each portion may be disposed upon the surface of an imaginary cone having its vertex situated within the arc tube, or beyond the arc tube and within the volume of the other coil portion. The ends of each of the solenoid portions furthest from one another are connected together, and the remaining closely-positioned coil ends provide a sufficiently high starting potential, responsive to receiving an excitation signal, for providing a magnetic field; at any instant the magnetic field of each of the two portions combines in-phase in the volume, between the closer ends of both portions, into which the arc tube is normally inserted.

19 Claims, 2 Drawing Sheets

INVERTED EXCITATION COIL FOR HID LAMPS

BACKGROUND OF THE INVENTION

The present invention relates to electrodeless high-intensity-discharge (HID) lamps and, more particularly, to a novel inverted excitation coil for initiating and maintaining a plasma arc discharge within the arc tube of the electrodeless HID lamp.

It is now well known to provide a toroidal light-emitting plasma within the envelope of a HID lamp. The induction arc plasma depends upon a solenoidal, divergence-free electric field for its maintenance; the field is created by the changing magnetic field of an excitation coil, which is typically in the form of a solenoid. It is necessary to develop a very high electric field gradient across the arc tube to start the plasma discharge; it is difficult to develop a sufficiently high electric field gradient, especially in the associated excitation coil, because the coil current may be prohibitively high, even if it is provided only on a pulse basis. Further, providing a very high electric field gradient may be impossible because the necessary field-per-turn of the excitation coil may exceed the turn-to-turn electrical breakdown rating of that coil. Thus, it is difficult to provide some means for starting induction-driven HID lamps, and it is also difficult to provide for hot restarting of the same type of lamp. While the use of a single spiral starting aid is described and claimed in co-pending allowed application Ser. No. 226,584, filed August 1988, assigned to the assignee of the present application and incorporated here in its entirety by reference, the use of even one additional structure, within a HID lamp, has negative cost and manufacturing impact. It is therefore not only highly desirable to provide some means for starting the HID lamp plasma discharge, but also to do so by means of some special configuration of the excitation coil, so that at least one additional member, utilized only for the starting operation, need not be provided.

BRIEF SUMMARY OF THE INVENTION

In accordance with the invention, a novel excitation coil for both starting and maintaining a plasma arc discharge within the envelope of an arc tube in an electrodeless HID lamp, comprises first and second solenoidally-wound coil portions, each having an axis substantially in alignment with the axis of the other portion. Preferably the coil conductor of each portion is disposed upon the surface of an imaginary cone having its vertex situated within the arc tube, or beyond the arc tube and within the volume of the other coil portion. Both coil portions have the conductor thereof wound in the same direction, when viewed from a position along the axis and beyond the coil. The ends of each of the solenoid portions furthest from one another are connected together, and the remaining closely-positioned coil ends, responsive to receiving an excitation signal, to provide a high voltage field causing a glow discharge to be formed in the arc tube to aid in starting the plasma arc discharge. At any instant the magnetic field of each of the two portions combines in-phase in the volume (between the closer ends of both portions) into which the arc tube is normally inserted, to maintain the arc discharge.

In one presently preferred embodiment, the inverted excitation coil is formed of conductive ribbon, and is utilized within a lamp also containing a capacitive network for matching the inductance of the excitation coil to a predetermined impedance.

Accordingly, it is one object of the present invention to provide a novel inverted excitation coil for starting and maintaining a plasma arc discharge within an arc tube of an electrodeless HID lamp.

This and other objects of the present invention will become apparent upon a reading of the following detailed description, when considered in conjunction with the appended drawings.

DETAILED DESCRIPTION OF THE INVENTION

Figure 1:
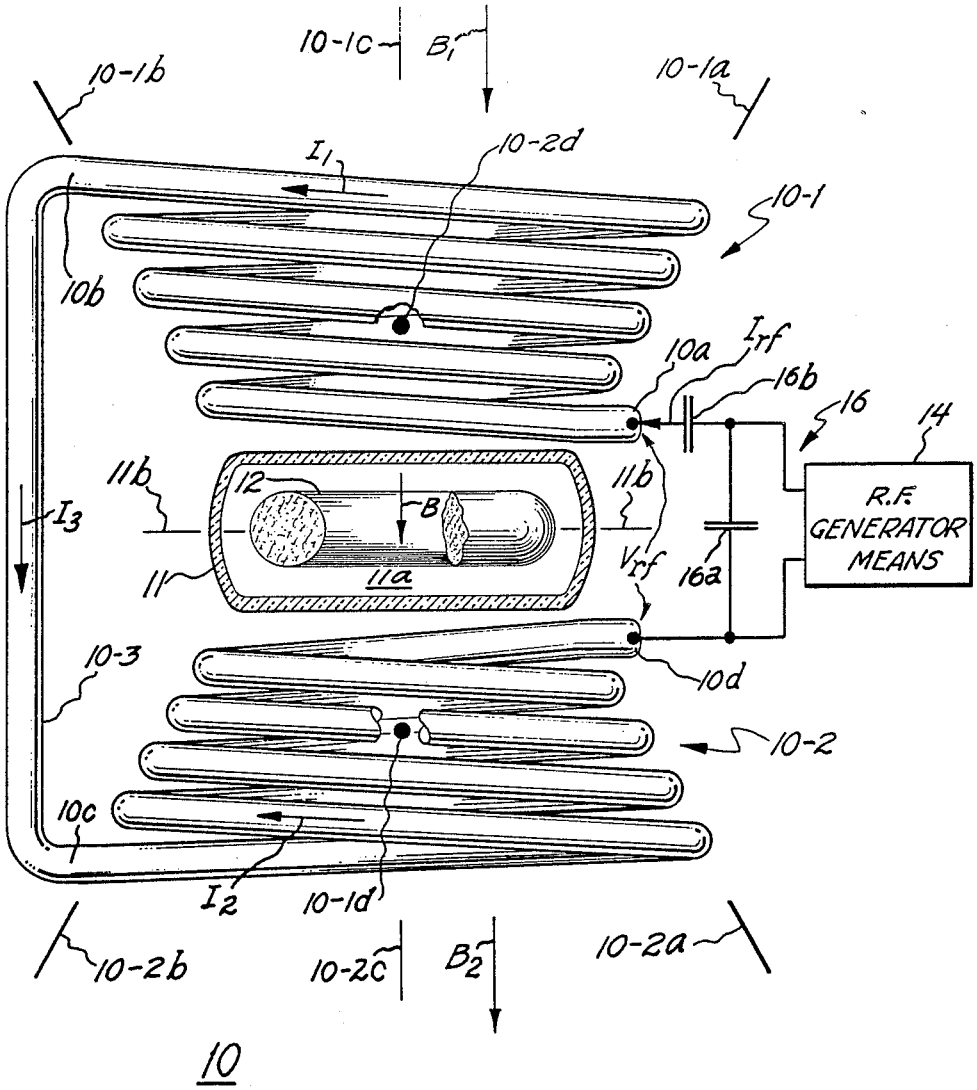
FIG. 1 is a side view of one presently preferred embodiment of the novel inverted excitation coil of the present invention, and of the arc tube, matching network and RF generator means with which it is used in a HID lamp.

Referring initially to FIG. 1, a presently preferred embodiment 10 of my novel excitation coil is utilized with an arc tube 11 of a HID lamp, to start and maintain a toroidal light-producing plasma arc discharge 12, within an arc tube interior volume 11*a* filled with a substantially gaseous mixture of a noble gas (such as xenon, krypton and the like, at a pressure on the order of 100–500 Torr) and at least one metal halide (such as sodium iodide, cerium iodide and the like). The toroidal discharge plasma 12 is formed and maintained responsive to a radio-frequency (RF) induction magnetic field produced by the flow of a RF current $I_{rf}$ caused to flow in the excitation coil 10 responsive to a RF voltage $V_{rf}$ provided to the coil from a RF generator means 14, preferably through an impedance matching network 16 (which may contain a shunt capacitor 16*a* and a series capacitor 16*b*), for matching the substantially inductive impedance of coil 10 to a predetermined generator means output impedance at the frequency of use, e.g. at 13.56 MHz.

In accordance with the invention, excitation coil 10 is comprised of first and second solenoidal coil portions 10-1 and 10-2, each having substantially the same plurality of turns and arranged such that the resulting portion magnetic fields $B_1$ and $B_2$ add in-phase to produce an increased total magnetic field B in the arc tube, when the tube is placed between the coil portions. The axes 10-1*c* and 10-2*c* of the portions are aligned with one another, and may even be coincident. Preferably, each of the coil portions is arranged upon the surface of one of a pair of imaginary cones having sloping sides 10-1*a* and 10-1*b*, or 10-2*a* and 10-2*b*, converging towards a conical apex 10-1*d* or 10-2*d*, which lies within the volume beyond the narrower end of the truncated-conical coil portion, and preferably lies within the volume enclosed by the other coil portion. Each conical portion has an apex angle, between sides 10-1*a* and 10-1*b* or sides 10-2*a* and 10-2*b*, substantially the same as the apex angle of the other portion; advantageously, each conical portion is a right angle cone. Thus, the truncated cone formed by upper, first excitation coil portion 10-1 has its inwardly-tapering opposite sides 10-1*a* and 10-1*b* extended to meet at the portion apex 10-1*d* lying within the volume enclosed by the other portion 10-2, just as the apex 10-2*d* of the lower, second coil portion 10-2 (formed by the convergence of that portion's opposite edges 10-2*a* and 10-2*b*) lies within the volume enclosed within upper first coil portion 10-1. Each coil portion has a narrower first end and a wider second end. Thus, upper first coil portion 10-1 has a first end 10*a* at the narrower, starting end of the winding of the conductor of that portion, and a second end 10*b* at the wider spiral end, and lower second coil portion 10-2 has a "second" end 10*c* at the wider end and a "first" end 10*d* at the narrower end. A conductive portion 10-3 connects the outer, or wide, ends 10*b* and 10*c* of the two coil portions. Thus, the RF current $I_{rf}$ instantaneously flowing into the narrower end 10*a* of the first coil portion 10-1 flows, as viewed from above the coil, in a clockwise direction, as shown by arrow $I_1$; the current then flows downwardly, as shown by arrow $I_3$, through joining conductor portion 10-3; and then flows through second portion 10-2 in a like clockwise direction, as shown by arrow $I_2$, when viewed from the same vantage point above the entire coil 10. As both portion currents $I_1$ and $I_2$ flow in the same circular direction, the magnetic fields $B_1$ and $B_2$ induced thereby flow in the same direction, herein illustrated as downwardly, so that both magnetic portions add, to produce a reinforced magnetic field B within the arc tube interior volume 11*a*.

In operation, when the HID lamp is to be started, the RF voltage $V_{rf}$ (between the terminals at the inner, or narrower, ends 10*a* and 10*d*) generates the portion magnetic fields $B_1$ and $B_2$, both instantaneously in the same direction, even though the total field alternates at the RF current frequency. The high voltage $V_{rf}$ between the opposed narrower coil portion ends provides a high electric field across the tube and capacitively induces a glow discharge within the arc tube to aid in starting the toroidal plasma 12. In this respect, coil 10 is "inverted" from the normal coil geometry, in which the generator is connected to the outer ends of the coil; by inverting the coil connections, the full RF voltage is applied to the coil ends closest to the arc tube, so that an increased electric field is obtained to aid in starting the arc discharge. Once the plasma has been formed, the normal induction magnetic field maintains the light-producing toroidal plasma arc discharge, until the RF signal is removed and operation ceases. It will be seen that an additional starting member is not required for use with the novel inverted excitation coil of the present invention.

In experiments, a tube filled with 500 Torr krypton/-sodium and cerium iodides was repeated started and run in a coil with currents between about 14 and 16.5 amperes, without any additional starting aids. Another tube (250 Torr krypton/sodium and cerium iodides) was also repeatedly started and run at coil currents between about 12 and 13 amperes. A third tube (250 Torr xenon/sodium and cerium iodides) was started and run at 30–35 ampere coil currents.

Figure 2:
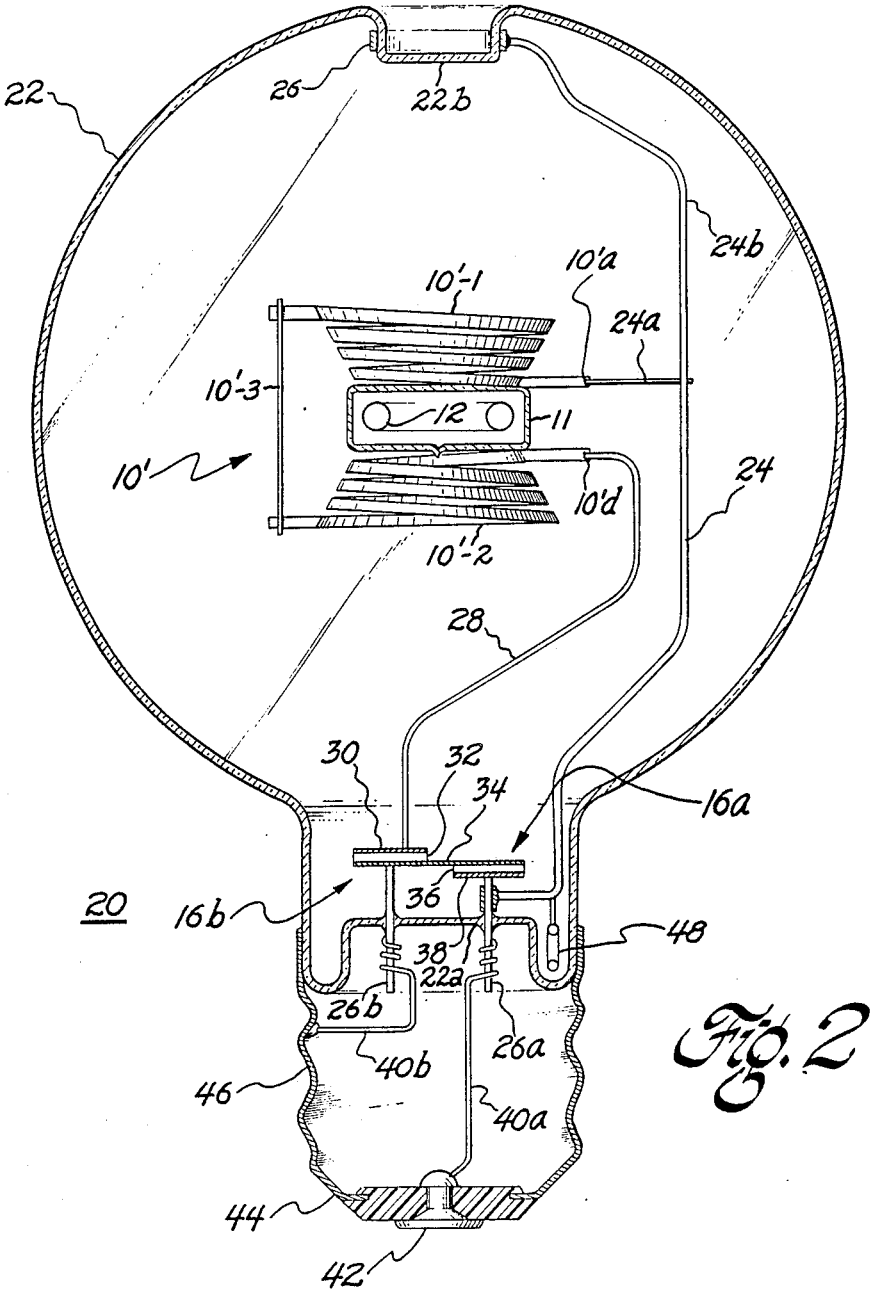
FIG. 2 is a sectional side view of one presently preferred embodiment of a HID lamp utilizing another presently preferred embodiment of the novel inverted excitation coil of the present invention.

Referring now to FIG. 2, an electrodeless HID lamp 20 includes an arc tube 11 in which plasma arc discharge 12 is to be formed, responsive to the starting and maintaining action of inverted excitation coil 12', to produce light which will radiate through the interior volume of the lamp and pass through the light-transmissive envelope 22 thereof. The arc tube envelope is so shaped as to be physically contained between, and supported by, the narrower ends of the coil portions 10'-1 and 10'-2. The coil portions can be fabricated of a conductive ribbon, as shown, or of a solid or hollow tube, of circular or other cross-section, as required. The wider-end-connecting portion 10'-3 can be a conductive rod, suitably joined to the wider ends of portions 10'-1 and 10'-2, or may be an integral portion, as in coil 10 in FIG. 1. One coil inner end 10'*a*, at which an external connection is to be formed, can be fastened to, and supported by, a conductive member 24*a*, forming a portion of a first support assembly 24, also including a second conductive member 24*b* which extends from a first conductive post 26*a*, in the envelope base 22*a*, to a support ring 26, formed about a suitable formation 22*b* in that portion of envelope 22 opposite to base 22*a*. First conductive means 26*a* and second conductive means 26*b* both pass through the envelope means base 22*a* in gas-tight manner. Means 26*b* is coupled to a second conductive support member 28, which connects to, and supports, the other connection end 10'*d* of the inverted excitation coil 10'. Advantageously, second support member 28 is connected to a first conductive electrode 30 which is separated by a dielectric member 32 from a common conductive electrode 34, which is connected to conductive means 26*b*; electrodes 30 and 34 and insulator 32 form the capacitor 16*b* of the RF impedance matching means. Electrode 34 is also separated by a second dielectric member 36 from a second conductive electrode 38, connected to first conductive means 26*a*, to form the capacitor 16*a* of the RF impedance matching means. It should be understood that the dielectric constant of members 32 and 36, as well as the areas thereof and the areas and shapes of conductive members 30, 34 and 38, can all be selected so as to realize the particular capacitances and capacitance ratios desired for matching means 16.

Conductive means 26*a* is connected via a first lead means 40*a* to a first conductive contact portion, such as contact button 42, which is insulatively spaced by an insulator means 44 from a second conductive contact portion, such as contact shell 46, which is itself connected by a second lead means 40*b* to second conductor means 26*b*, so that the two separate contact means 42 and 46 (which may form a standard Edison base and the like for lamp 20) allow connection, via a mating socket, to an RF generator means (not shown). Suitable gettering means 48, and like lamp accessory features, as known to the art, may be utilized.

While several presently preferred embodiments of my novel inverted excitation coil for starting and maintaining an arc plasma discharge within the arc tube of a HID lamp have been described in detail herein, it will now become apparent that many modifications and variations can be made by those skilled in the art. Thus, any inverted coil configuration providing good inductive coupling, low coil resistive loss and low (preferably, minimum) light absorption can be used; the coil can be conduction or radiation-cooled and may even include formations for holding/locating/supporting the arc tube. It is my desire, therefore, to be limited only by the scope of the appending claims and not by the specific details and instrumentalities presented by way of explanation herein.

What I claim is:

1. An excitation coil, adaptable for use with an arc tube in an electrodeless high-intensity-discharge (HID) lamp, comprising:

first and second solenoidal portions of coiled conductor, each with an axis substantially aligned with the axis of the other portion, each wound in a common direction to produce, responsive to a signal current flowing in the same direction through both portions, a magnetic field adding in-phase to the magnetic field of the other portion, and each with a first end located nearest to a central volume in which said arc tube can be positioned and a second end located further from the other portion than the first end; and another conductive portion connecting the two second ends to one another;

the pair of first ends being adapted to receive a radio-frequency signal of characteristics selected to cause said coil to start and maintain a plasma arc discharge in said arc tube.

2. The coil of claim 1, wherein the coiled conductor of each coil portion has a conical-spiral shape, with the first end being a narrower end and the second end being a wider end.

3. The coil of claim 2, wherein each conical-spiral shape is a right-angle cone and has substantially the same apex angle as the other cone.

4. The coil of claim 2, wherein each portion is of truncated conical shape.

5. The coil of claim 4, wherein the imaginary apex of the truncated cone is located within the volume enclosed by the other coil portion.

6. The coil of claim 5, wherein each cone is a right-angle cone and has substantially the same apex angle as the other cone.

7. The coil of claim 1, wherein the conductor of at least one of the portions is a ribbon conductor.

8. The coil of claim 1, wherein at least one coil portion further includes means of maintaining the position of an arc tube locatable between the coil portions.

9. An electrodeless high-intensity-discharge (HID) lamp, comprising:

an arc tube containing a substantially gaseous mixture emitting light responsive to a plasma arc discharge formed therein;

an excitation coil for starting and maintaining the arc discharge responsive to a signal, said coil comprising first and second solenoidal portions of coiled conductor, each portion disposed upon an opposite side of the arc tube from the other portion and each having an axis substantially aligned with the axis of the other portion, the conductor of each portion being wound in a common direction to produce, responsive to a single current flowing in the same direction through the conductor of both portions, a magnetic field adding in-phase to the magnetic field of the other portion in at least a central volume occupied by the arc tube, and each portion having a first end located nearest to said arc tube and a second end located further from the other portion than the first end; and another conductive portion connecting the second ends of the coil portions to one another; and means for coupling to the coil portion first ends a radio-frequency signal of characteristics selected to cause said coil to start and maintain a plasma arc discharge in said arc tube.

10. The lamp of claim 9, wherein the coiled conductor of each coil portion has a conical-spiral shape, with the first end being a narrower end and the second end being a wider end.

11. The lamp of claim 10, wherein each cone is a right-angle cone and has substantially the same apex angle as the other cone.

12. The lamp of claim 10, wherein each portion is of truncated conical shape.

13. The lamp of claim 12, wherein the imaginary apex of the truncated cone is located within the volume enclosed by the other coil portion.

14. The lamp of claim 13, wherein each cone is a right-angle cone and has substantially the same apex angle as the other cone.

15. The lamp of claim 9, wherein the conductor of at least one of the portions is a ribbon conductor.

16. The coil of claim 9, wherein at least one coil portion further includes means of maintaining the arc tube between the coil portions.

17. The lamp of claim 9, further comprising structural means for establishing and maintaining the position of the coil and arc tube within the envelope.

18. The lamp of claim 17, wherein said structural means also includes means for matching the electrical impedance of the coil to a preselected impedance.

19. The lamp of claim 9, further comprising means for matching the impedance of the coil to a preselected impedance.

* * * * *